US006086106A

United States Patent [19]

Joe et al.

[11] Patent Number: 6,086,106

[45] Date of Patent: Jul. 11, 2000

[54] DOUBLE VISION COVER AND BINDER ASSEMBLY

[75] Inventors: Laurel S. Joe, Santa Monica; Bruce Allen Carter, Lake Forest; Norman Yamamoto, Yorba Linda, all of Calif.; Cloyd Dixon Rauch, III, Portland, Oreg.

[73] Assignee: Avery Dennison Corporation, Pasadena, Calif.

[21] Appl. No.: 09/156,242

[22] Filed: Sep. 18, 1998

[51] Int. Cl.[7] ..... B42F 3/00

[52] U.S. Cl. ..... 281/31; 281/31; 281/29; 281/37; 402/73; 402/4; D19/27; 206/455; 206/37; 206/39; 40/775

[58] Field of Search ..... 281/31, 29, 37; 402/70, 73, 4; 206/455, 450, 37, 39; D19/27; 40/775; 428/39

[56] References Cited

U.S. PATENT DOCUMENTS

| | | | |
|---|---|---|---|
| D. 182,105 | 2/1958 | Chase . | |
| D. 225,791 | 1/1973 | Nast . | |
| D. 266,771 | 11/1982 | Wihlke . | |
| D. 350,365 | 9/1994 | Kelley et al. . | |
| 4,336,754 | 6/1982 | Loeb | 101/127 |
| 4,629,349 | 12/1986 | Pitts | 281/31 |
| 4,795,194 | 1/1989 | Etheredge | 281/34 |
| 4,893,837 | 1/1990 | Pugliese et al. | 281/31 |
| 4,971,363 | 11/1990 | Templet | 283/67 |
| 4,991,767 | 2/1991 | Wyant | 229/1.5 R |
| 5,000,543 | 3/1991 | Curtin | 350/140 |
| 5,059,052 | 10/1991 | Casper | 402/80 |
| 5,063,637 | 11/1991 | Howard, Jr. | 16/225 |
| 5,114,009 | 5/1992 | Johnston | 206/494 |
| 5,240,340 | 8/1993 | Lynch et al. | 402/79 |
| 5,261,701 | 11/1993 | Walters | 281/31 |
| 5,330,281 | 7/1994 | Kalan | 281/15.1 |
| 5,360,655 | 11/1994 | McDonald | 281/2 |
| 5,375,936 | 12/1994 | Jennison et al. | 402/73 |
| 5,375,937 | 12/1994 | Oh | 402/73 |
| 5,411,293 | 5/1995 | Monzyk | 281/31 |
| 5,445,417 | 8/1995 | Bromer et al. | 281/46 |
| 5,489,120 | 2/1996 | Thornsburg | 281/33 |
| 5,586,829 | 12/1996 | Schwartz | 402/79 |
| 5,634,667 | 6/1997 | Jordan | 40/28.1 |
| 5,711,627 | 1/1998 | Chapman | 402/3 |

*Primary Examiner*—Willmon Fridie, Jr.
*Assistant Examiner*—Alisa L Thurston
*Attorney, Agent, or Firm*—Oppenheimer Wolff & Donnelly LLP

[57] ABSTRACT

A double vision binder includes a front cover, a rear cover and a binding portion; a large transparent pocket is formed on the front cover of the binder by a layer of transparent sheet material bonded to the front cover on three sides; and additional smaller transparent pockets are bonded to the first transparent layer, so that a large sheet of background visual material may be inserted in the large pocket, with an overlay of additional visual material in the small pockets. the first layer may extend over the entire outer surface of the binder to provide additional pockets on the rear cover and on the binding portion of the assembly. A plurality of the small pockets may be formed from a single transparent sheet, with pockets separated by bonding lines.

20 Claims, 9 Drawing Sheets

DOUBLE VISION COVER AND BINDER ASSEMBLY

FIELD OF THE INVENTION

This invention relates to binders with transparent pockets on the front covers of the binders.

BACKGROUND OF THE INVENTION

It has previously been proposed to have one or more transparent pockets on the covers of binders, as shown for example in L. A. Kelley, et al. U.S. Pat. No. Des. 350,365 granted Sep. 6, 1994, and H. S. Chase U.S. Pat. No. Des. 182,105 granted Feb. 18, 1958.

However, these binder constructions are somewhat limited in the displays which they provide.

SUMMARY OF THE INVENTION

Accordingly, it is an object of the invention to provide a cover arrangement for binders which provides more flexibility, depth and variety.

In accordance with the present invention, therefore, a binder having a front cover, a rear cover and an intermediate binding portion, along with arrangements for holding paper or pages within the binder, includes a first layer of transparent material bonded to the outer surface of the front cover on three sides, with the fourth side open to provide a large pocket substantially coextensive with the front cover of the binder; and additional transparent layer material mounted on the first layer to form an overlay of additional relatively small pockets on the front cover of the binder.

Additional features or aspects of the invention may involve the following:

1. The additional small overlay pockets may be formed as a strip or strips with continuous bonding to the first layer of transparent material, along one edge of the strip or strips, and vertical lines of bonding to separate the strips into small pockets.
2. The small pockets may be of different sizes.
3. The small pockets may be symmetrically mounted on the cover and each pocket may extend toward one comer of the cover.
4. The first or inner transparent layer may extend over the binding and, selectively, over the back cover of the binder, to provide an additional transparent pocket or additional transparent pockets, both along the binding and on the back cover of the binder, or on only one of these locations.
5. The smaller pockets may be formed of sections of transparent sheet material, with two more of the pockets being formed of a single section of the transparent material with the pockets being separated by bonding lines.

Advantages of the double vision binder assembly include providing the opportunity for the manufacturer to insert a large "sell sheet" in the larger inner pocket while providing additional printed "sell" cards in one or more of the small pockets. Also, consumers could insert a background sheet into the larger pocket, as a backdrop for personal photos to be inserted in the smaller pockets. Also, photographer consumers could insert a collage of visual material into the larger product, with individual whole photos in the smaller outer pockets.

Other features and advantages of the invention will become apparent from a consideration of the following detailed description and the associated drawings.

DETAILED DESCRIPTION OF THE PREFERRED EMBODIMENTS

The present invention relates to binders with transparent pockets on the front cover of the binders. The transparent pockets are configured to form a "double vision" cover. The double vision cover is suitable for any type of binder for sheets of paper or other material in which a plurality of large and small sheets of visual material may be presented on the front cover of the binder. In the particular embodiment shown in FIGS. 1–3 and herein described, the binder is a three-ring binder for the releasable binding of reports, records, and like assemblies of papers, photographs and the like. However, it should be understood that the principles of the invention are equally applicable to virtually any form of binder for permanently or removably retaining sheets or pages of paper or the like.

Figure 1:
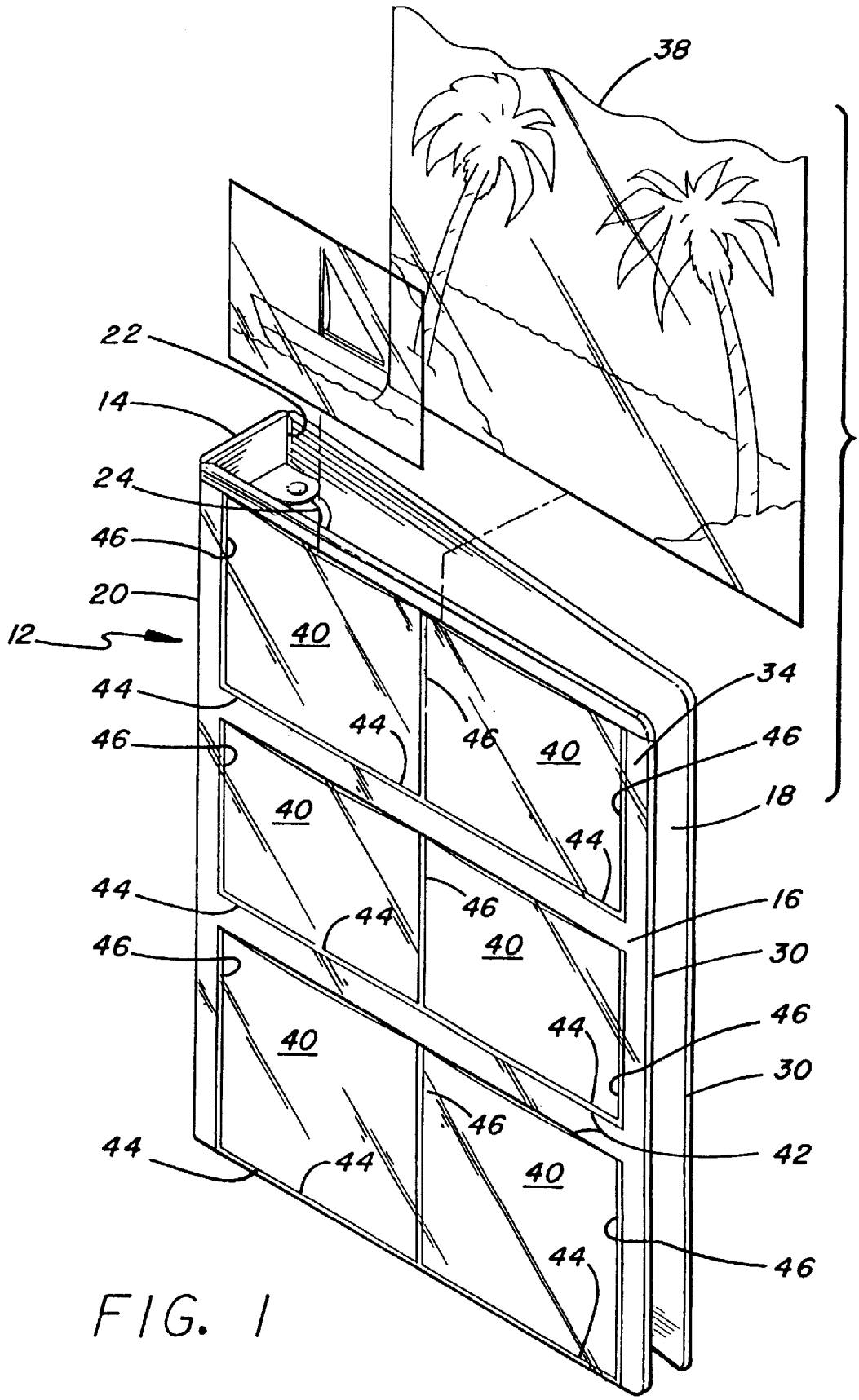
FIG. 1 is a perspective view of a three-ring binder having a double layer of transparent pockets illustrating the principles of the invention.

Referring to FIG. 1, a three-ring binder 12 of a standard size for 8½ inches by 11 inches sheets is illustrated, including a spine 14, a front cover 16 and a back cover 18 connected to the opposite edges of the spine 14 by hinges 20, 22. The front cover 16 and back cover 18 have a width of about 10 inches and a height of about 11½ inches, and the spine may have a width of about 2 inches. The three-ring binder 12 has rings adapted to be opened for receiving sheet-like material having spaced holes along the inner edge for alignment with the rings 24.

Many other types of binders exist, such as binders having more or less than three-rings. The rings may be formed of a metal such as steel or light weight and inexpensive material such as a plastic. The binder may also be sized to accommodate sheets larger or smaller than 8½ inches by 11 inches. For example, typical carry-type organizers and calendars are usually about 5 inches by 7 inches, while binders for photo albums can be about 12 inches by 15 inches. The covers for the binder may also have various configurations. For example, a binder may have three covers of approximately equal size hinged together along the opposite lateral edges of the central cover, and one of these hinged area includes the rings. The present invention is intended to work equally well with these and other types of binders.

In the particular embodiment shown in the drawings and herein described, the spine 14, front cover 16 and back cover 18 are each formed of a substantially solid and continuous construction. The front cover 16 includes an inner substantially solid base plate (not shown) of paper board or other suitable material. The plate extends substantially throughout the complete width and height of the front cover 16. A decorative and utilitarian opaque plastic cover enclosure or shell (not separately shown) encloses the base plate. The shell includes an inner plastic sheet and an outer plastic sheet extending over the base plate. The outer edges of the opaque sheets extend slightly beyond the base plate and are joined and sealed to each other to form a lip 30. The opaque sheets merge into and are integrally formed with the hinges. In addition, the inner and outer opaque plastic sheets of the shell correspondingly extend over the spine 14, the back cover 18 and hinge 20 to define the outer shell of the three-ring binder 12, including the lip 30. In this embodiment of the present invention, the inner and outer plastic sheet is 12 gauge polyvinyl chloride, 0.012 inch thick.

The construction of the binder 12 is not limited to the above description. The shell can comprise a cosmetically appealing woven fabric instead of the plastic cover described about. In another type of binder, the paper board base plate can be replaced with a visually appealing solid or flexible plastic sheet material which does not require a shell.

Figure 2:
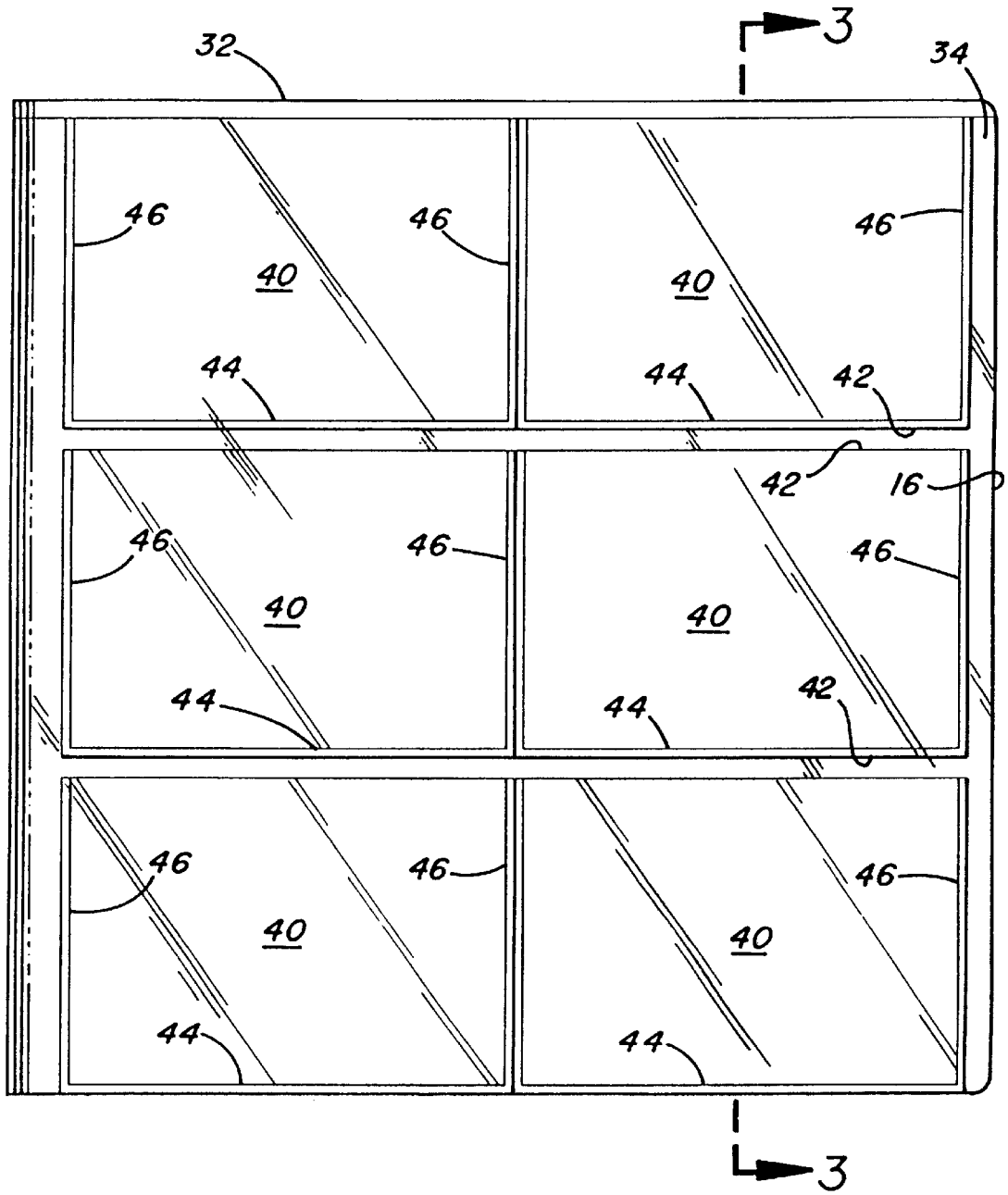
FIG. 2 is a top view of the embodiment shown in FIG. 1 illustrating the large pocket and the plurality of small pockets.
Figure 3:
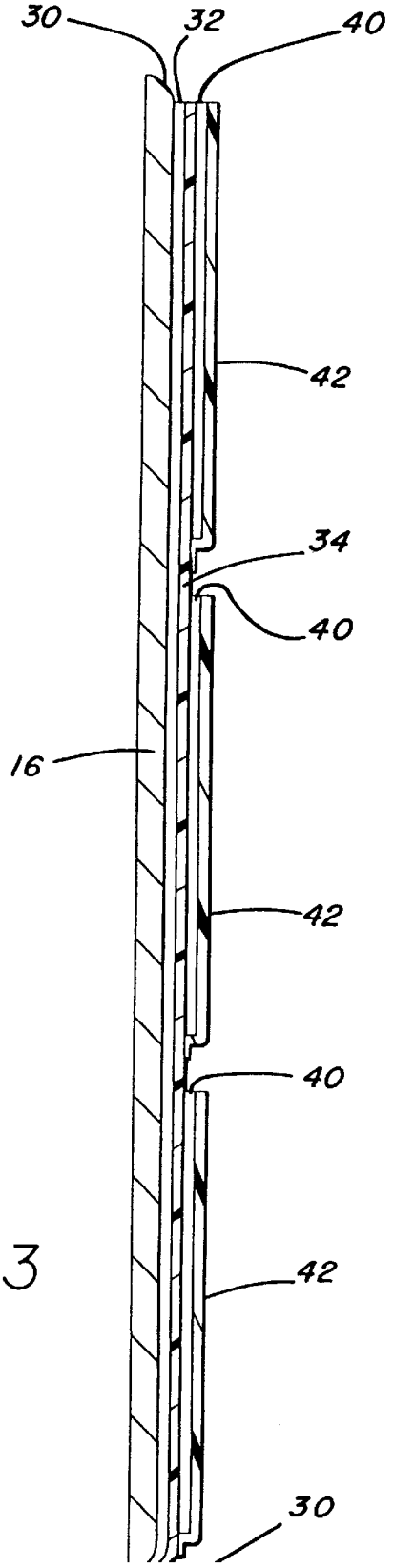
FIG. 3 is a cross-sectional view taken through the front cover of the binder along line 3—3 of FIG. 2.

In accordance with the teaching of the present invention, the illustrated embodiment of FIGS. 1–3 includes a large pocket 32 which extends to the outer edges of the front cover 16 such that the dimensions of the large pocket 32 are substantially the same as the outer dimensions of the front cover 16. The large pocket 32 may comprise any known transparent material. Preferably, the large pocket 32 is made of a flexible transparent plastic sheet 34 secured to the front cover 16.

In the illustrated embodiment of FIGS. 1–3, the opposite side edges and the bottom edge of the transparent plastic sheet 34 project outwardly into merged engagement with corresponding hinge 22 and lip 30 of the shell, and are secured thereto by any means generally known in the art. For example, the transparent plastic sheet 34 can be welded or bonded by heat, ultrasonic welding, or high frequency electrical bonding. The transparent plastic sheet 34 can be welded or bonded to the front cover 16 simultaneously with the welding or bonding of the inner and outer plastic sheets over the base plate. In this embodiment, the inner and outer plastic sheets and transparent plastic sheet may be heat and pressure bonded by high frequency or ultrasonic welding. The top side of the large pocket 32 is left unsecured to the front cover 16 to define a top insert opening to pocket 32. A large sheet of visual material can be inserted into the large pocket 32 through the top insert opening.

In addition to the large pocket, FIGS. 1–3 illustrate a plurality of small pockets 40 on the front cover 16. The small pockets 40 are arranged in a two by three matrix configuration, and each small pocket 40 has a width of about 5 inches and a height of about 3½ inches. The small pockets 40 are preferably, but not necessarily, formed of the same transparent material as the large pocket 32.

In the illustrated embodiment of FIGS. 1–3, the small pockets 40 may be formed by extending continuous strips 42 of transparent material transversely across substantially the full width of the front cover 16 and by continuously welding or bonding the bottom edges 44 of the strips 42 to the transparent plastic sheet 34 of the large pocket 32. Opposite sides of each of the small pocket 40 comprise bonding lines 46 extending substantially perpendicular to the bottom edge 44 of the strips 42. The top side of each small pocket 40 is left unsecured to the transparent plastic sheet 34 to define a top insert opening. Preferably, the strips 42 are first welded or bonded onto the transparent plastic sheet 24 of the large pocket 22. The strip/sheet combination is then welded or bonded to the front cover 16 simultaneously with the welding or bonding of the inner 26 and outer plastic sheets 28 over the base plate. One of the advantages of using the continuous strips 42 to form the small pockets 40 is the ability to produce the small pockets 40 at a relatively low cost due to the simplified means of construction.

The transparent plastic sheet and strips are formed of polyvinyl chloride which is about 0.007 inch thick, but they may also be formed of other transparent plastic material such as a polyolefin material. It is contemplated that the transparent plastic sheet and strips may be between 0.004 and 0.015 inch thick in preferred embodiments.

As illustrated in FIG. 1, the large sheet of visual material 38 may be inserted in the large pocket 32 and a plurality of relatively small sheets of visual material 52 may be inserted into the small pockets 40 to provide a double vision collage of small sheets of visual material 52 superimposed on the large sheet of visual material 38. As noted above, advantages of the double vision binder assembly include providing the opportunity for the manufacturer to insert a large "sell sheet" in the large pocket 32 while providing additional printed "sell" cards in one or more of the small pockets 40. Also, consumers could insert a background sheet into the large pocket 32, as a backdrop for personal photos to be inserted in the small pockets 40. Also, photographer consumers could insert a collage of visual material into the large pocket 32, with individual whole photos in the small pockets 40.

Figure 4:
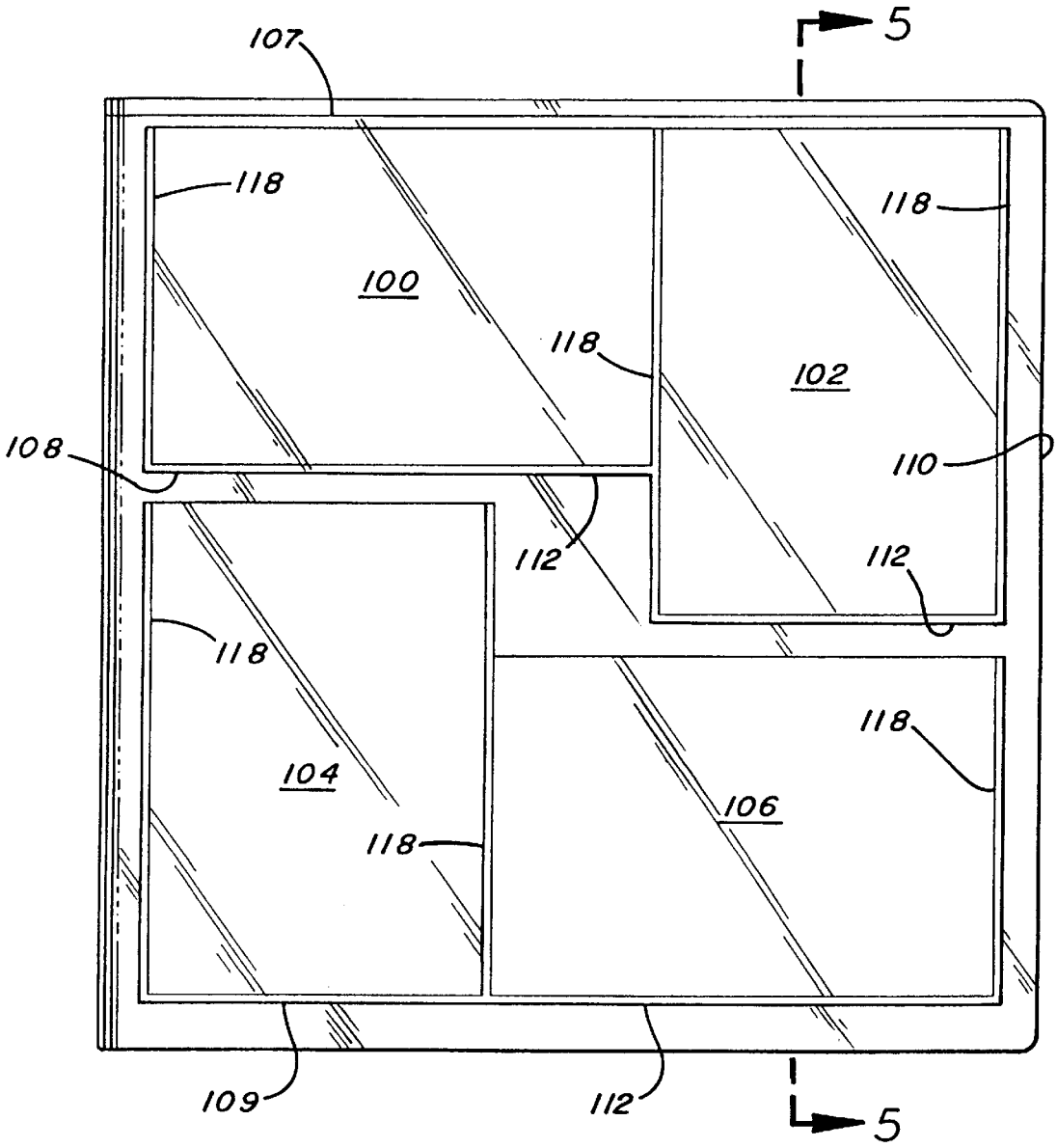
FIG. 4 is a top view of an alternative embodiment of the present invention illustrating a large pocket and a plurality of small pockets on a front cover of a binder.
Figure 5:
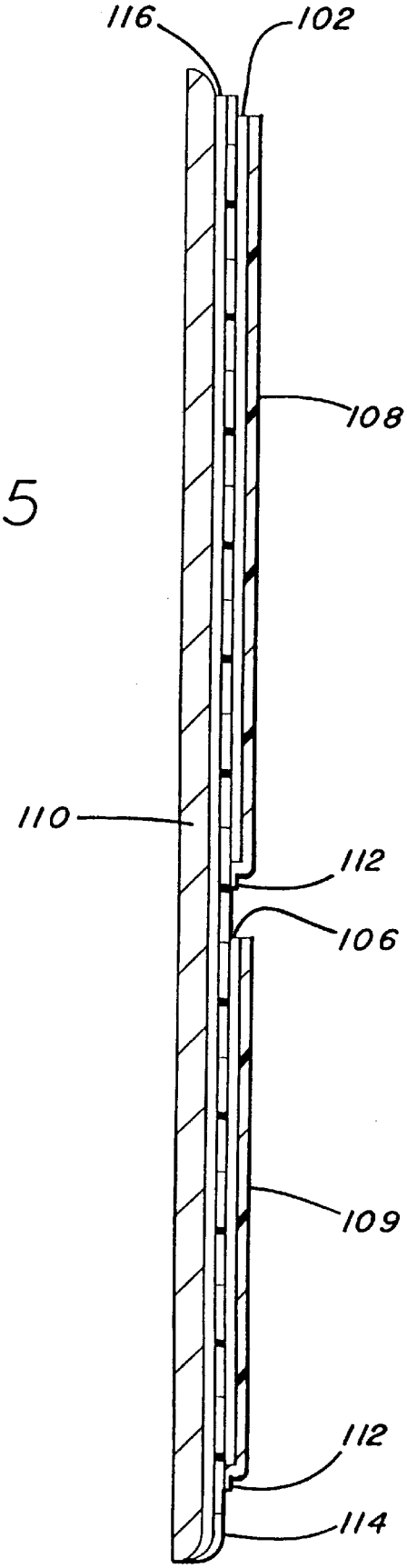
FIG. 5 is a cross-sectional view taken through the front cover along line 5—5 of FIG. 4.

Referring now to FIGS. 4–5, a second embodiment of a double vision cover and binder assembly is illustrated. In this embodiment, small pockets 100, 102, 104, 106 vary in size and are arranged in a non-matrix configuration on a large pocket 107. The first small pocket 100 has a width of about 6½ inches and a height of about 4 inches, and the second small pocket 102 has a width of about 4 inches and a height of about 6 inches. The third small pocket 104 has dimensions similar to the second pocket 102, while the fourth small pocket 106 has dimensions similar to the first pocket 100.

In the illustrated embodiment of FIGS. 4–5, the large pocket 107 and the small pockets may be formed in the manner described in the embodiment of FIGS. 1–3 wherein continuous strips 108, 109 of transparent material are extended transversely across substantially the full width of the front cover 110, and the bottom edges 112 of the strips 108, 109 and welded or bonded to 1 transparent plastic sheet 114 of a large pocket 116. It is noted that the bottom edges 112 of the first strip 108 comprises three edges, while the bottom edge of the second strip 109 comprises a single edge. Opposite sides of each of the small pockets 100, 102, 104, and 106 comprise welding or bonding lines 118 extending substantially perpendicular to the bottom edge 112 of the strips 108, 109. The top side of each small pocket 100, 102, 104, and 106 is left unsecured to the transparent plastic sheet 114 to define a top insert opening. It is also noted the top edge of the first strip 108 comprises a single edge, while the top edges of the second strip 109 comprise three edges.

Preferably, the strips 108, 109 are first welded or bonded onto the transparent plastic sheet 114 of the large pocket 116, and then the strip/sheet combination is welded or bonded to the front cover 110 simultaneously with the welding or bonding of the inner and outer plastic sheets over the base plate.

Figure 6:
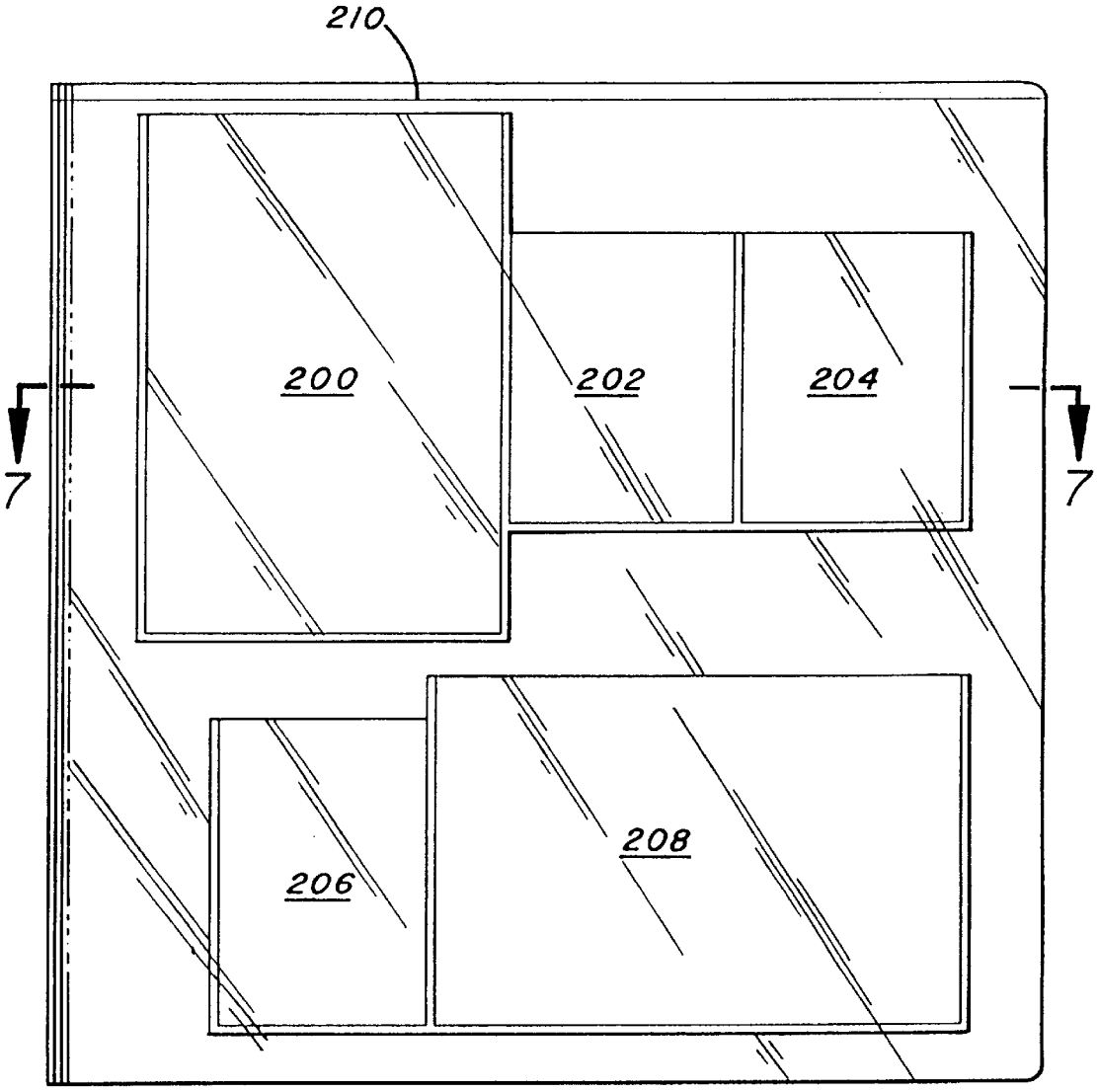
FIG. 6 is a top view of another alternative embodiment of the present invention illustrating a large pocket and a plurality of small pockets of different sizes on the front cover of a binder.
Figure 7:
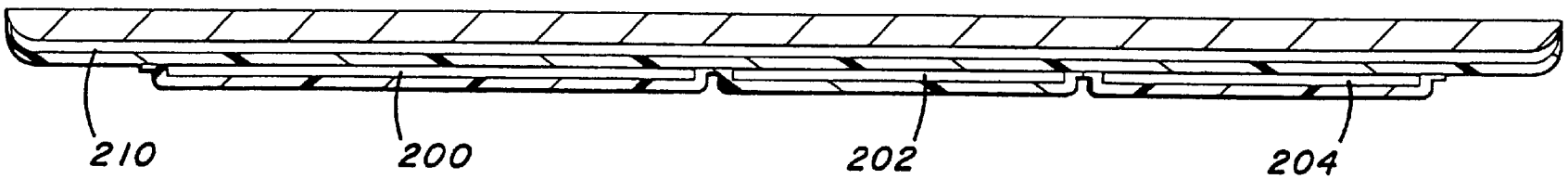
FIG. 7 is a cross-sectional view taken through the front cover along line 7—7 of FIG. 6.

Referring now to FIGS. 6–7, a third embodiment of a double vision cover and binder assembly is illustrated. The small pockets 202, 204, 206, and 208 vary in size and are also arranged in a non-matrix configuration on the large pocket 210. A first row of small pockets includes the first pocket 200 having a width of about 4 inches and a height of about 6 inches, and second and third small pockets each having a width of about 2¼ inches and a height of about 3½ inches. The second row of small pockets includes the fourth small pocket 204 having a width of about 2½ inches and a height of about 3½ inches, and the fifth small pocket 206 having a width of about 6 inches and a height of about 4 inches. In this embodiment, the large pocket 200 and small pockets 202, 204, 206, and 208 may be formed in the same manner as described in the embodiment of FIGS. 1–3.

Regarding the construction of FIGS. 1–3, the small pockets 110, 102, 104, and 106 may be formed either by die cutting rectangular areas of transparent material and welding three sides of each pocket closed; or by using the three strips 418 of transparent plastic, and welding the edges of the strips 418 near the edge of the binder and near the hinge concurrently with securing the underlying large pocket 400 in place.

Figure 8:
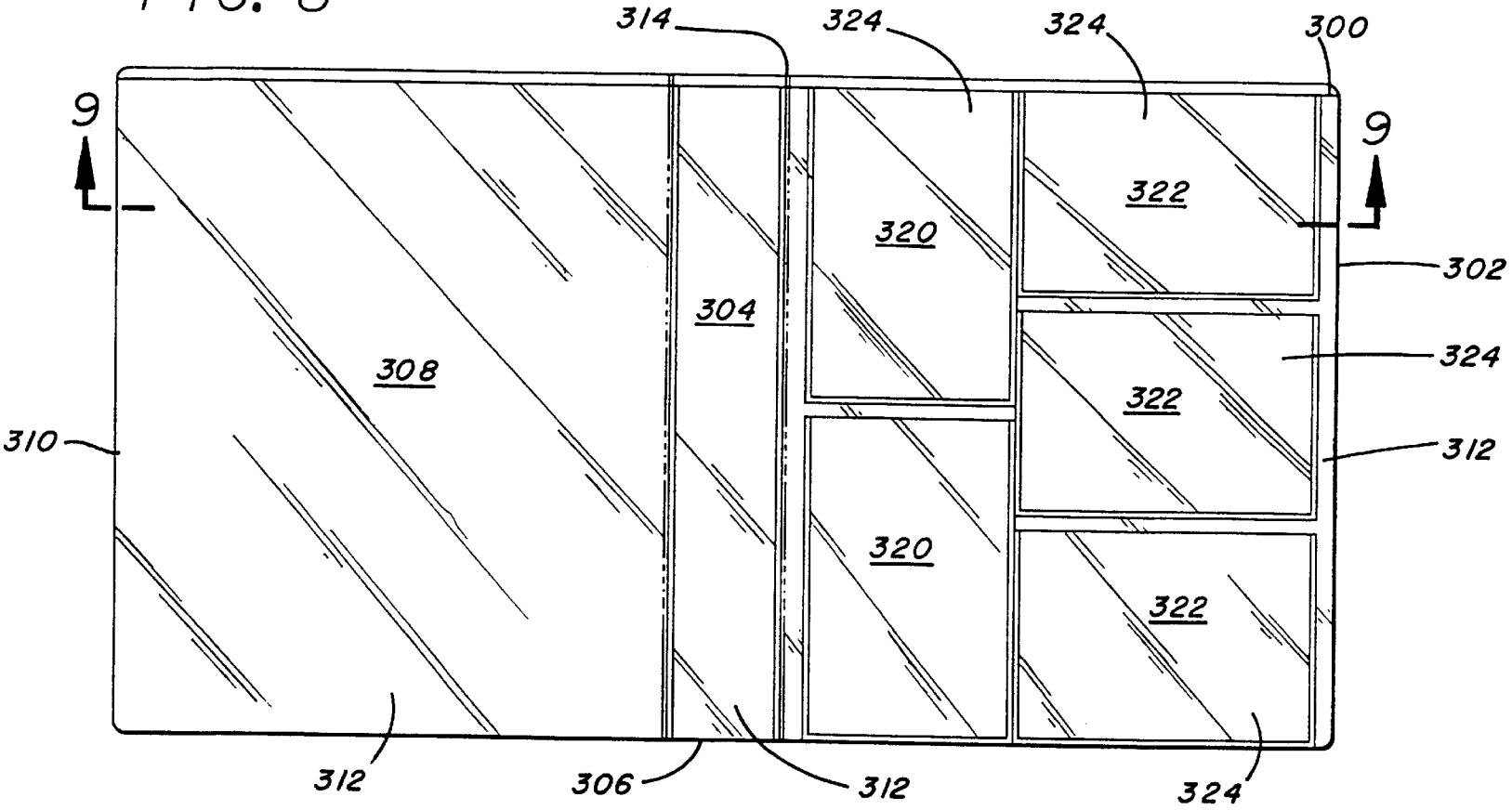
FIG. 8 is a top view of still another alternative embodiment of the present invention illustrating large pocket and overlay pockets on the front cover, a spine pocket, and a second large pocket on a back cover.
Figure 9:
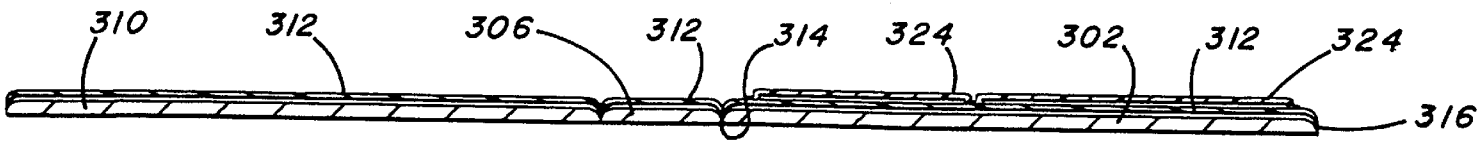
FIG. 9 is a cross-sectional view taken through the front cover, spine, and back cover along line 9—9 of FIG. 8.

Referring now to FIGS. 8–9, a fourth embodiment of a double vision cover and binder assembly is illustrated. This embodiment includes a large pocket 300 on the front cover 302, a spine pocket 304 on the spine 306, and a second large pocket 308 on the back cover 310. The large pocket 300, spine pocket 304, and second large pocket 308 each, respectively, extend to the outer edges of the front cover 302, spine 306, and back cover 310 wherein the pockets 300, 304, and 308 comprise a transparent plastic sheet 312. The opposite side edges and the bottom edge of the transparent plastic sheet 312 project outwardly into merged engagement with corresponding hinge 314 and lip 316 of the front cover 302, and are welded or otherwise bonded thereto. The transparent plastic sheet 312 may be welded or bonded to the front cover 302 simultaneously with the welding or bonding of the inner and outer plastic sheets which cover the base plate. The top side of the large pocket 300 is left unsecured to define a top insert opening to the pocket 300. In addition, the transparent plastic sheet 312 extends over the spine 306, the back cover 310 and hinge 314 to define the spine pocket 304 and second large pocket 308. The transparent plastic sheet 312 is secured to the spine 306 and second large pocket 308 in the same fashion as securing the transparent plastic sheet 312 onto the front cover 302.

The embodiment illustrated in FIGS. 8–9 include a plurality of small pockets 320, 322 formed on the front cover 302. The small pockets 320, 322 are arranged in columns wherein the first column includes first 320 and second small pockets 320 each having a width of about 5¾ inches and a height of about 4 inches. The second column includes third, fourth, and fifth small pockets 322 each having a width of about 4 inches and a height of about 5¾ inches. The size of the small pockets and the overall height and width of the binder may be tailored as desired to fit standard size photographs, in accordance with consumer preferences.

The small pockets 320, 322 illustrated in FIGS. 8–9 are formed by cutting rectangular areas of transparent material 324 and by welding the three edges of the transparent material 324 onto the transparent plastic sheet 312 of the large pocket 300. The top side of each small pocket 320, 322 is left unsecured to the transparent plastic sheet 312 to define a top insert opening. The transparent plastic sheet 312 of the large pocket 300 may be welded onto the front cover 302 before or after the small pockets 320, 322 are welded onto the transparent plastic sheet 312 of the large pocket 300.

Figure 10:
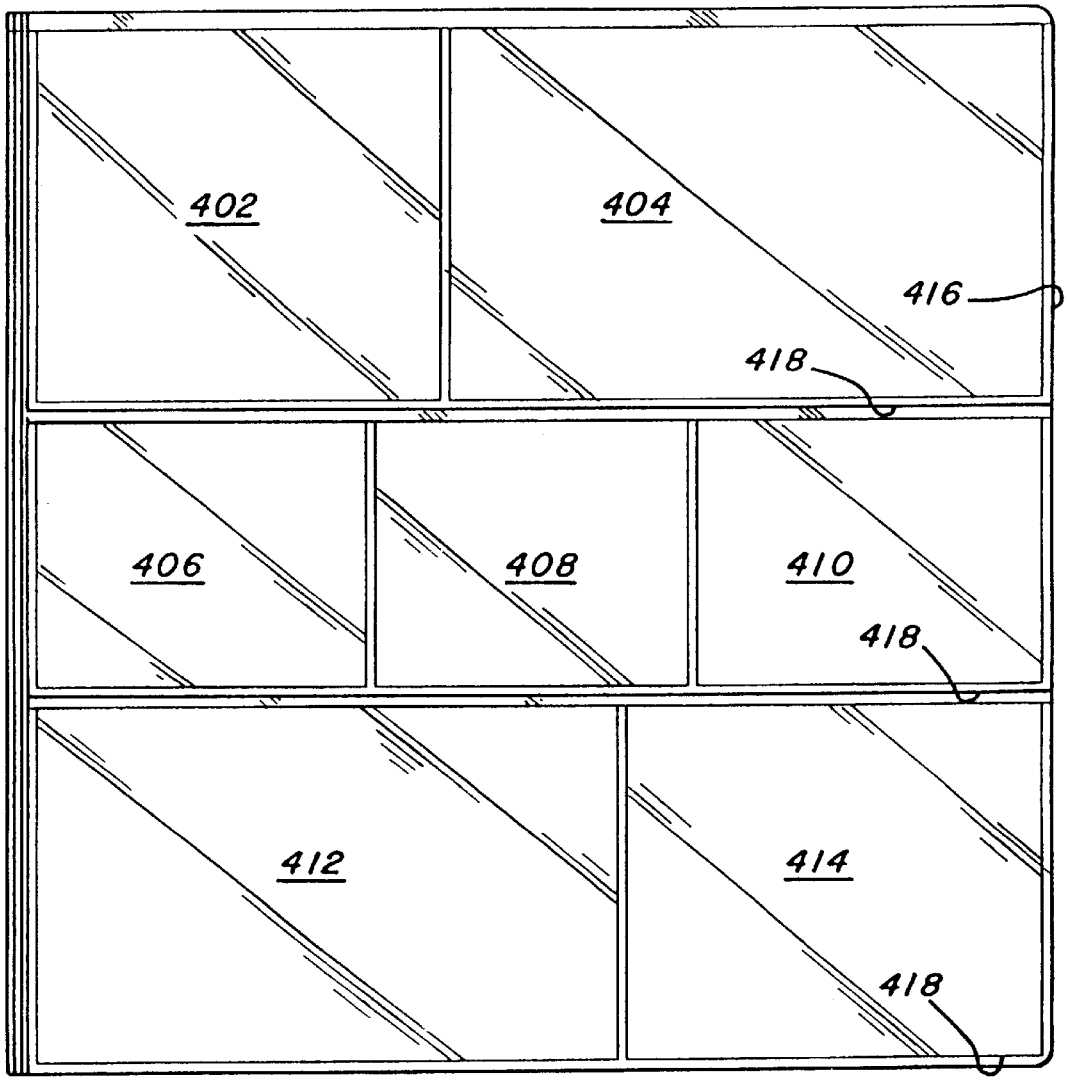
FIG. 10 is a top view of still another alternative embodiment of the present invention illustrating a large pocket and a plurality of small pockets.

Referring now to FIG. 10, a fifth embodiment of a double vision cover and binder assembly is illustrated. This embodiment includes a large pocket as in FIG. 1, and a plurality of small overlay pockets 402, 404, 406, 408, 410, 412, and 414 on the front cover 416. It is noted that this embodiment includes several small pockets with sides and bottom edges which extend to the edges of the front cover 416.

A first row of small pockets includes the first pocket 402 having a width of about 4 inches and a height of about 4 inches, and a second small pocket 404 having a width of about 6 inches and a height of about 4 inches. A second row of pockets includes the third small pocket 406 having a width of about 3 inches and a height of about 2¾ inches, a fourth small pocket 408 having a width of about 4 inches and a height of 2¾ inches, and a fifth small pocket 410 having the dimensions similar to the third small pocket 406. A third row of pockets includes the sixth small pocket 412 having a width of about 6 inches and a height of about 4 inches, and a seventh small pocket 414 having a width of about 4 inches and height of about 4 inches.

In the embodiment illustrated in FIG. 10, the large pocket and small pockets 402, 404, 406, 408, 410, 412, and 414 may be formed in the same manner as described in the embodiment of FIGS. 1–3 wherein strips 418 are first welded or bonded onto a transparent plastic sheet of the large pocket as in FIG. 1. The strip/sheet combination is then welded or bonded to the front cover 416 simultaneously with the welding or bonding of the inner and outer plastic sheets of the base plate. It is noted that the sides and bottom edges of the small pockets which are adjacent to an edge of the front cover 416 are formed during the second welding process.

Although the present invention has been described in detail with regarding the exemplary embodiments and drawings thereof, it should be apparent to those skilled in the art that various adaptations may be accomplished without departing from the spirit and scope of the invention. For instance, transparent plastic sheets may be secured to the front cover, spine, and back cover with an adhesive. The transparent plastic sheets which form the plurality of small pockets may also be secured to the front cover with an adhesive.

The small pockets described above can be configured with shorter or longer width and height dimensions. The small pockets can be non-rectangularly shaped to accept circular, oval, and other shaped sheets of visual material. In addition, small pockets may also be formed on the back cover of the binder. Accordingly, the invention is not limited to the precise embodiment shown in the drawings and described in detail hereinabove.

What is claimed is:

1. A double vision cover and binder assembly comprising:

a binder having front and back covers and an intermediate binding portion;

page or sheet holding arrangements mounted in said assembly adjacent said binder portion;

a first transparent layer bonded to said front cover on three sides, and having one side open to form a large pocket substantially coextensive with said binder front cover;

additional transparent layer material mounted on and bonded to said first transparent layer to form an overlay of a plurality of additional relatively small pockets on the front cover of said binder; and said small pockets being formed as strips of transparent material which extend transversely across substantially the full width of said front cover of said binder, and which are bonded to said first transparent layer along one edge of said strips and by bonding lines extending substantially perpendicular to said edge;

whereby a large sheet of visual material may be inserted in said large pocket, and a plurality of relatively small sheets of visual material may be inserted into said small pockets to provide a double vision collage of the small sheets of visual material superimposed on the large sheet of visual material.

2. A double vision cover and binder assembly as defined in claim 1 wherein said small pockets are of different sizes.

3. A double vision cover and binder assembly as defined in claim 1 wherein said first transparent layer extends over the back cover of said binder and is bonded to said assembly to form a second large pocket on the back cover of said binder assembly and a smaller vertically extending pocket on the binder portion of said assembly.

4. A double vision cover and binder assembly as defined in claim 1 wherein said first transparent layer extends over the back cover of said binder and is bonded to said back cover to form a second large pocket on the back cover of said binder assembly.

5. A double vision cover and binder assembly as defined in claim 1 further including a large background visual sheet in said large pocket and a small visual sheet in at least one of said small pockets.

6. A double vision cover and binder assembly comprising:

a binder having front and back covers and arrangements for mounting pages in said binder assembly;

a first transparent layer bonded to said front cover on three sides, and having one side open to form a large pocket substantially coextensive with said binder front cover; and additional transparent layer material mounted on said first transparent layer to form an overlay of a plurality of additional relatively small pockets on the front cover of said binder;

whereby a large sheet of visual material may be inserted in said large pocket, and a plurality of relatively small sheets of visual material may be inserted into said small pockets to provide a double vision collage of the small sheets of visual material superimposed on the large sheet of visual material.

7. A double vision cover and binder assembly as defined in claim 6 wherein said small pockets are formed as strips of transparent material which extend transversely across substantially the full width of said front cover of said binder; whereby the use of continuous strips simplifies the construction of the transparent overlay portion of the assembly.

8. A double vision cover and binder assembly as defined in claim 6 wherein said small pockets are of different sizes.

9. A double vision cover and binder assembly as defined in claim 6 wherein said small pockets extend toward comers of said front cover and are symmetrically located with respect to the center of said front cover.

10. A double vision cover and binder assembly as defined in claim 6 wherein said first transparent layer extends over the back cover of said binder and is bonded to said back cover to form a second large pocket on the back cover of said binder assembly.

11. A double vision cover and binder assembly as defined in claim 6 wherein at least two of the smaller pockets are formed from a single sheet of flexible transparent material, with the two pockets being separated by a bonding line.

12. A double vision cover and binder assembly comprising:

a binder having front and back covers and an intermediate binding portion;

a first transparent layer bonded to said front cover on three sides, and having one side open to form a large pocket substantially coextensive with said binder front cover; and additional transparent layer material mounted on said first transparent layer to form an overlay of a plurality of additional relatively small pockets on the front cover of said binder;

whereby a large sheet of visual material may be inserted in said large pocket, and a plurality of relatively small sheets of visual material may be inserted into said small pockets to provide a double vision collage of the small sheets of visual material superimposed on the large sheet of visual material.

13. A double vision cover and binder assembly as defined in claim 12 wherein said small pockets are formed as strips of transparent material which extend transversely across substantially the full width of said front cover of said binder and which are bonded to said first transparent layer by bonding lines extending along one edge of said strips and by bonding lines extending perpendicular to said edge; whereby the use of continuous strips simplifies the construction of the transparent overlay portion of the assembly.

14. A double vision cover and binder assembly as defined in claim 12 wherein said small pockets are of different sizes.

15. A double vision cover and binder assembly as defined in claim 12 wherein said small pockets extend toward comers of said front cover and are symmetrically located with respect to the center of said front cover.

16. A double vision cover and binder assembly as defined in claim 12 wherein said first transparent layer extends over the back cover of said binder and is bonded to said back cover to form a second large pocket on the back cover of said binder assembly.

17. A double vision cover and binder assembly as defined in claim 10 wherein at least two of the smaller pockets are formed from a single sheet of flexible transparent material, with the two pockets being separated by a bonding line.

18. A double vision cover and binder assembly as defined in claim 12 further including a large background visual sheet in said large pocket and a small visual sheet in at least one of said small pockets.

19. A double vision cover and binder assembly comprising:

a binder having front and back covers and an intermediate binding portion;

a first transparent layer secured to said front cover, said transparent layer extending over the greater portion of said front cover;

said assembly including an accessible space between said transparent sheet and said cover into which visual material may be placed; and additional transparent layer material mounted on said first transparent layer to form a plurality of additional relatively small pockets on said first transparent layer;

whereby a large sheet of visual material may be inserted in said accessible space and a plurality of relatively small sheets of visual material may be inserted into said small pockets to provide a double vision collage of the small sheets of visual material superimposed on the large sheet of visual material.

20. A double vision cover and binder assembly comprising:

a binder having opaque front and back covers and an intermediate binding portion;

ring type page or sheet holding arrangements mounted in said assembly adjacent said binder portion;

said opaque front and back covers having dimensions greater than 8½ inches by 11 inches, to readily accommodate standard 8½ inch by 11 inch or A-4 size sheets;

a first transparent layer bonded to said front cover on three sides, and having one side open to form a large pocket substantially coextensive with said binder front cover; and additional transparent layer material mounted on and bonded to said first transparent layer to form an overlay of a plurality of additional relatively small pockets on the front cover of said binder;

whereby a large sheet of visual material may be inserted in said large pocket, and a plurality of relatively small sheets of visual material may be inserted into said small pockets to provide a double vision collage of the small sheets of visual material superimposed on the large sheet of visual material.

* * * * *